United States Patent [19]

Bakker

[11] 4,409,696

[45] Oct. 18, 1983

[54] APPARATUS FOR CARRYING A PERSON IN SITTING CONDITION

[76] Inventor: Johannes P. Bakker, Van Galenlaan 28, 3941 VD Doorn, Netherlands

[21] Appl. No.: 234,188

[22] Filed: Feb. 13, 1981

[30] Foreign Application Priority Data

Feb. 14, 1980 [NL] Netherlands ..... 8000939

[51] Int. Cl.[3] ..... A61G 7/08

[52] U.S. Cl. ..... 5/81 B; 5/89

[58] Field of Search ..... 5/81 R, 81 B, 83, 84, 5/85, 86, 87, 88, 89

[56] References Cited

U.S. PATENT DOCUMENTS

| | | | |
|---|---|---|---|
| 2,649,829 | 10/1953 | Bakker | 5/81 R |
| 3,222,029 | 12/1965 | Mildemann | 5/81 R |
| 3,234,508 | 2/1966 | Rischer | 5/89 |
| 3,407,413 | 10/1968 | James | 5/86 |
| 3,608,104 | 9/1971 | Van Gerven | 5/83 |

FOREIGN PATENT DOCUMENTS

| | | | |
|---|---|---|---|
| 950017 | 2/1964 | United Kingdom | 5/89 |

*Primary Examiner*—Alexander Grosz

*Attorney, Agent, or Firm*—Cushman, Darby & Cushman

[57] ABSTRACT

The apparatus for carrying a person in a sitting condition includes an upper carrying web which loops around the person's back and extends forwards under the person's arms and a lower carrying web which loops under the person's lower thighs and extends forwards to the left and right of the person's lower thighs. A support frame is provided with a carrying lever cantilevered to the frame so as to have a free end. A support member having two arms pivotally secured thereto, projects forwards from connection to the carrying lever free end. The two arms are biased laterally apart and connect with opposite ends of the upper carrying web. Rods projecting downwards from the support member connect with engagement devices on the lower carrying strap, including two at opposite ends of the lower carrying strap for mounting the lower carrying strap to the support member. The upper carrying web is sufficiently long that the arms, upon pivoting towards one another due to the weight of the person, tend to wrap the upper carrying web further about the person, thus helping to more securely hold the person.

13 Claims, 3 Drawing Figures

APPARATUS FOR CARRYING A PERSON IN SITTING CONDITION

BACKGROUND OF THE INVENTION

The invention relates to an apparatus for carrying a person in sitting condition comprising a carrying lever mounted in cantilever fashion on a frame and a support member suspended from the free end thereof, said support member having an upper transverse portion with a set of engagement points for the extremities of an upper carrying web to be guided behind the back and under the arms of the person to be carried, this transverse portion having at the lower end a set of engagement points for the extremities of a carrying element to be guided directly behind the knee hollows below the upper legs. Such an apparatus is known from the Dutch Pat. No. 110,348 as well as from the U.S. Pat. No. 3,694,829. In this known apparatus the transverse portion of the support member is constituted by a rod extending to both sides of the central longitudinal plane of the support member, said rod being provided at both its free ends with enlargements behind which fastening eyes provided at the free ends of the upper carrying web may engage.

A disadvantage of this known apparatus which has been encountered in practice is that persons being in a failing physical condition as well as persons having decreased muscle control tend to slide out of the upper carrying web so that finally they remain suspended in an awkward posture on the laterally curved upper arms.

The invention aims at meeting this disadvantage. This aim is achieved according to the invention in that the transverse portion of the support member is constructed such that the relative engagement points take in the unloaded condition a mutually spreaded position but are moved towards each other in the carrying position of the apparatus under the influence of the forces then imparted thereto by the upper carrying web.

SUMMARY OF THE INVENTION

In the apparatus according to the invention the engagement points for the carrying web extremities are situated in the unloaded condition spaced as much as in the known apparatus which facilitates the application of the carrying web round the upper body of a person still lying on a bed or sitting in a wheel-chair. However, in the apparatus according to the invention, as soon as the carrying web is loaded when the person to be carried is lifted from the bed or from the wheel chair respectively, it is tensioned more strongly round the upper body whereby the danger of sliding downwardly is opposed. The engagement points for the carrying web will thereby yield progressively and therefore tighten the carrying web in an improved manner around the upper body as the weight of the carried person is larger.

In a practical embodiment according to the invention the transverse portion comprises two arms which are pivotable around axes situated in or adjacent to the central longitudinal plane of the support member, said arms being pivotable from a maximum spreaded position against spring pression to a position in which they have a smaller spread angle. Preferably the arms are coupled by gears or gear sectors provided on their pivot axes. In this manner there is achieved that the arms always carry out the same angle rotation in spite of possible differences in the values of the forces imparted thereto so that any tendencies to a slanted suspended position are opposed.

According to a further feature of the invention in which the support member is secured in a manner known per se to the lower end of a vertical shaft which is rotatably journalled in a sleeve provided at the free end of the carrying lever, the pivot axes of the arms are mounted between the flanges of a part which is U-shaped in the cross-section according to the central longitudinal plane of the support member, having its opening directed towards the person to be carried, said part being secured with its upper flange to the vertical shaft.

Particularly the U-shaped part is provided at its ends with brackets closing at that ends the space present between the flanges and constituting limiting abutments for the arms extending obliquely outwardly from the space, said brackets having extensions into two fork legs extending below the obliquely outwardly extending arms, said fork legs supporting at their free ends a shaft around which at least one supporting rod, carrying the lower carrying element and directed obliquely downwardly from the side of the person to be carried, is pivotable in a manner known per se in the direction of a more recumbent posture. By thereby shifting the pivot point for the supporting rod towards the person to be carried the centre of gravity of the carried person in a sitting condition will be situated substantially directly under the pivot point so that the support member adjusts itself automatically into the sitting position under the influence of the weight of the carried person. This represents an advantage relative to the known device according to the above mentioned U.S. patent in which the support member just tends to assume the recumbent position under the influence of the weight of the carried person and in which a locking lever has to be actuated in order to keep the carried person in the sitting condition.

In special cases it may be a disadvantage that the upper carrying web is tensioned around the upper body through the action of the arms as proposed by the invention. In such a case a blocking means is provided according to the invention whereby the arms may be blocked in their maximum spreaded position. Preferably this blocking means is mounted upwardly pivotable from an inoperative position between the fork legs into an operative position between the arms.

The invention is hereunder further explained with reference to the drawing of an embodiment given as an example.

DETAILED DESCRIPTION OF A PRESENTLY PREFERRED EMBODIMENT

Figure 1:
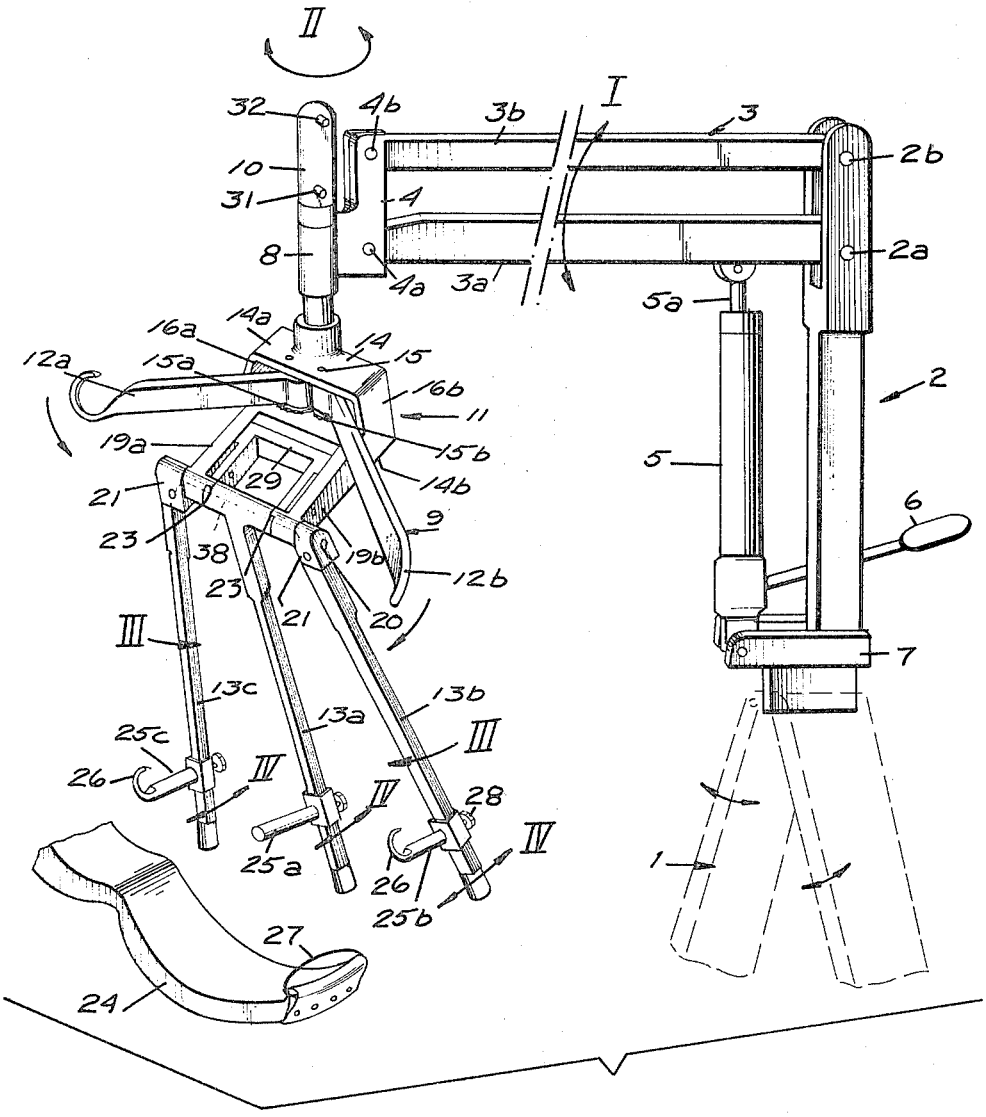
FIG. 1 shows a perspective view of the apparatus according to the invention, in which only the upper portion of the frame has been indicated by broken lines.

The apparatus as shown in the drawing comprises a base frame 1 which may be of a type known per se, e.g. a type as shown in one of both above mentioned patents and therefore is only partially shown in the drawing. Reference number 2 indicates a column having a carrying lever 3 extending in cantilever manner from that column, said column being permitted to be inserted in known manner vertically into the base frame and may be removed therefrom. The carrying lever proper comprises two parallel arms 3*a* and 3*b* which are pivotably connected to the column 2 and are joined at their free ends by a connecting pivot piece 4, the pivot points 4*a*, 4*b* of which together with the pivot points 2*a* and 2*b* on the column 2 constituting the apexes of a parallelogram. The carrying lever 3 may be moved upwardly and downwardly in the direction of the arrow I by means of a hydraulic piston-cylinder device 5 actuatable through a hand lever 6, the cylinder of the device being mounted pivotably on a part 7 secured to the column 2, the free end 5*a* of the piston rod being engaged with one of the parallel arms 3*a* at short distance from the column 2. The connecting pivot piece 4 carries a sleeve 8 which is parallel to the column 2 and as a result of the described parallelogram structure retains a vertical position during the movement upwardly and downwardly of the carrying arm.

The support member 9, to which the invention relates, is journalled in the sleeve 8 with a vertical shaft 10 and is rotatable in the direction of the arrow II.

Figure 2:
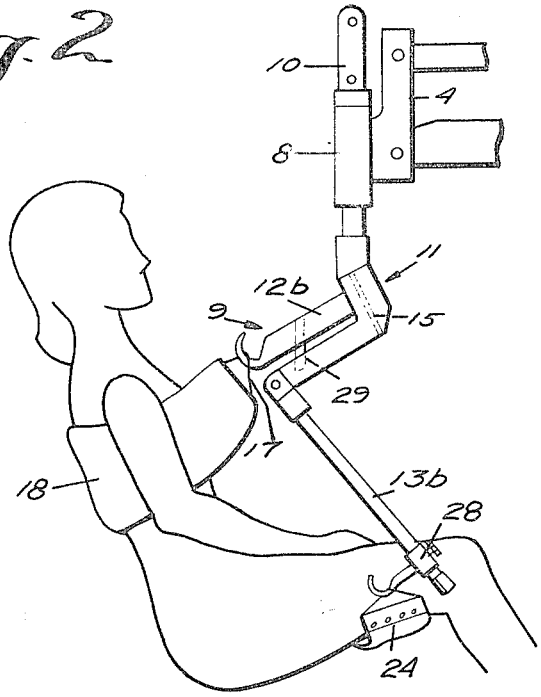
FIG. 2 is a side view which shows the apparatus in the operative carrying position for the sitting condition and FIG. 3 is a plan view of the transverse portion of the support member.
Figure 3:
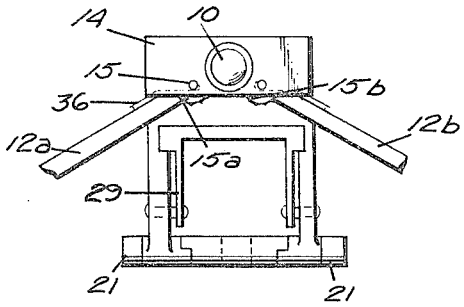

The support member 9 further comprises a transverse portion 11, secured to the lower end of the shaft 10 and having pivotable arms 12*a* and 12*b* as well as three supporting rods 13*a*, 13*b* and 13*c*. The transverse portion 11 comprises a housing 14 which has a U-shaped cross-section, the flanges 14*a* and 14*b* of which, as seen in the cross-section, have an oblique or slanting position of e.g. 30° relatively to the horizontal plane. The arms 12*a* and 12*b* are each pivotably mounted at one end in the space between the flanges 14*a* and 14*b* of the housing 14, namely around shafts 15 (see FIG. 2) which are perpendicular to said flanges and situated at short spacing at both sides of the central longitudinal plane of the housing. The arms 12*a* and 12*b* have been coupled by pinions or gear sectors 15*a*, 15*b* secured to the relative arm ends, the axes of which coincide with the pivot shafts 15. In FIG. 1 and FIG. 3 the arms 12*a* and 12*b* assume their maximum spread positions. In these positions the arms 12*a* and 12*b* are in engagement with the forwardly directed edges of the brackets 16*a* and 16*b* closing the housing 14 at the transverse ends and therefore constituting limiting abutments for the arms 12*a* and 12*b*. One or more springs 36 received in the housing, tend to retain the arms 12*a* and 12*b* in the maximum spread positions as shown. The free ends of the arms 12*a* and 12*b* are shaped as hooks for receiving the eyes 17 provided at the ends of the upper carrying web 18. (see FIG. 2).

The brackets 16*a* and 16*b* have extensions below the arms 12*a* and 12*b* and extending in the forward direction, i.e. to the side remote from the closed side of the housing 14, into two fork legs 19*a* and 19*b* respectively. Reference number 20 indicates a shaft which is rotatably journalled in the free ends of the fork legs 19*a* and 19*b*. The centre supporting rod 13*a* has been secured to the portion of said shaft extending between both fork legs, a holder 21 being secured to each of the ends of the shaft 20 extending outwardly from the fork legs 19*a* and 19*b*, in which holder the upper end has been mounted of a laterial supporting rod 13*b* and 13*c* respectively being pivotable around a pivot axis perpendicular with respect to the shaft 20. The three supporting rods 13*a*, 13*b* and 13*c* are contained in a common plane. Thereby both lateral supporting rods 13*b* and 13*c* may be pivoted inwardly according to the arrows III from the position as shown in FIG. 1 in which they have been pivoted (e.g. under the influence of a spring 38) maximally outwardly around their pivot axes.

The free ends of the fork legs 19*a*, 19*b* and the hub portion of the centre supporting rod 13*a* are provided with cooperating abutment faces 23, limiting the pivotal movement of the supporting rod 13*a*, 13*b* and 13*c*. FIG. 1 shows one of both limit positions, namely the position (substantially) corresponding to the position as taken by the supporting rods in the sitting condition of the person to be carried. From the position according to FIG. 1 the supporting rods may pivot in the direction of the arrows IV towards a position corresponding with a more recumbent posture of the person to be carried.

The supporting rods 13*a*, 13*b* and 13*c* are provided with engagement points for the lower carrying web indicated by the reference number 24. Said engagement points are constituted by pins 25*a*, 25*b* and 25*c* extending in the sitting condition substantially horizontally parallel to the central longitudinal plane of the support member. The outermost pins 25*b* and 25*c* are provided with hooks 26 for receiving the eyes 27 provided at the ends of the carrying web 24. The centre pin 25*a* simply serves as a bearing support for the centre of the carrying web 24. The pins 25*a*, *b*, *c* are secured to slides 28 which are slidable along the relative supporting rods 13*a*–*c* and may be fixed by clamping screws in the desired positions.

For lifting a person from a bed or from a wheel-chair one lowers the carrying lever 3, by exhausting the piston cylinder device 5 in a position in which the support member 9 is over the person to be lifted, through such a distance that the eyes 17 at the ends of the carrying web 18, guided around the back and under the arms of the person to be lifted, may be easily hooked onto the hookshaped free ends of the arms 12*a* and 12*b* which are in the spread position according to FIG. 1. It is therein important that the supporting rods 13*a*, 13*b*, 13*c* may pivot in the direction of the arrow IV to a more recumbent position. Thereafter the lower carrying web 24 is guided directly behind the knees and below the upper legs of the person to be carried and placed on the centre pin 25*a* and hooked on the outermost pins 25*b* and 25*c*. By actuation of the lever 6 the carrying lever is rotated upwardly and the patient is lifted from the bed or from the wheel-chair respectively whereby the arms 12*a* and 12*b* move towards each other and the supporting rods 13*a*–13*c* pivot towards the sitting position under the influence of the weight of the patient.

When the arms 12*a* and 12*b* move towards each other the upper carrying web 18 is solidly tensioned around the upper body of the patient. In some cases the physical condition of the patient may be such that it would be objectionable if the upper carrying web would be tensioned in the described manner around the upper body. Provisions have been made for such a case in order to prevent movement of the arms 12*a*, 12*b* towards each other from the spreaded position according to FIG. 1. Said provisions are constituted by a bracket shaped blocking means 29 which is pivotably mounted between the fork legs 19*a*, 19*b* and may be pivoted upwardly from an inoperative position between said fork legs towards an operative position. In the operative position the blocking means 29 constitutes an abutment for both arms 12*a*, 12*b* whereby they are prevented to pivot towards each other.

Finally it is to be noted that the vertical shaft 10 is received adjustably in the height direction in the sleeve 8. In FIG. 1 the shaft 10 has an upper position relative to the sleeve 8, said position being fixed by a locking pin 31 engaging the upper edge of the sleeve 8 or a bearing ring provided on top of that sleeve respectively and is pushed outwardly from the shaft 10 by spring action. Due to the fact that the locking pin 31 may be pushed inwardly against the spring action the shaft 10 may be lowered relative to the sleeve 8 towards a lower position in which the shaft is supported by a second locking pin 32. This second position of the shaft 10 permits moving the member 9 to a lower level so that e.g. a person may be lifted from a recumbent posture on a floor.

I claim:

1. Apparatus for carrying a person in a sitting condition, comprising:

an upper carrying web or strap having two opposite ends and being of sufficient length that, when looped under the person's arms and around the back of the person the two opposite ends thereof become disposed substantially to the front of the person's under arms;

respective engagement means provided on each of said opposite ends of said upper carrying strap;

a lower carrying web or strap having two opposite ends and being of sufficient length that when looped under the person's lower thighs in the vicinity of the person's back the two opposite ends thereof become disposed respectively laterally to the left and right of the person's lower thighs;

respective engagement means provided on each of said opposite ends of said lower carrying strap;

a support frame;

a carrying lever;

means mounting the carrying lever to the support frame in cantilever fashion, so that the carrying lever has a free end;

a support member including a housing;

means suspending the support member housing from said carrying lever free end;

said support member including two arms projecting laterally beside one another generally forwardly towards the person and each being provided with a respective forwardly-located engagement means constructed and arranged for cooperative securement to a corresponding respective said engagement means of said upper carrying strap;

each arm having a rearward portion pivotally connected to said support member housing about a respective generally vertical axis whereby said forwardly-located engagement means are movable generally laterally towards and away from one another;

means acting between said support member and said arms for tending to maximally spread said forwardly-located engagement means laterally apart yet permit such portion of the weight of the person being carried that is incumbent upon said upper carrying web to draw said forwardly-located engagement means relatively closer together whereby said upper carrying web tends to become wrapped about more of the girth of the person's thorax;

said support member further including two laterally spaced respective rod means projecting downwardly from means connecting respective one ends of said rod means to said support member; and each said rod means being provided distally of the respective one end thereof with a respective engagement means constructed and arranged for cooperative securement to a corresponding respective said engagement means of said lower carrying strap.

2. The apparatus of claim 1 wherein:

said housing of said support means includes:

a generally horizontal, transversally extending flange having a respective downwardly extending bracket member formed at each lateral end thereof;

said arms being pivotally connected to said support member housing about said respective generally vertical axes, by pivot means pivotally connecting said arms to said flange generally medially of said housing; and said brackets providing limiting stops for pivotal movement of said arms away from one another about said respective vertical axes.

3. The apparatus of claim 1, wherein:

said arms are pivotally connected to said support member housing about said respective generally vertical axes by pivot means pivotally connecting said arms to said support member housing generally medially of said housing.

4. The apparatus of claim 2 or claim 3, wherein:

each said axis about which a respective arm pivots is located in a vertical plane, and also is obliquely oriented, top forwards, so that the substantially complete loop containing both said arms and said upper carrying web, formed when said apparatus is carrying a person suspended in a sitting condition, is oriented at about 30° to the horizontal.

5. The apparatus of claim 2, wherein:

said support member further includes a vertically-oriented shaft projecting upwards from a medially-located, support-providing connection with said flange of said support member bracket;

said means for suspending the support member housing from said carrying lever free end comprising:

a vertically-oriented sleeve mounted on said carrying lever free end;

said vertically-oriented shaft of said support member being journalled in said vertically-oriented sleeve; and means on said vertically-oriented shaft supporting said vertically-oriented shaft for rotation in said vertically-oriented sleeve.

6. The apparatus of claim 5, wherein:

said brackets are each generally L-shaped so as to have respective generally forwardly projecting legs having respective forwardly-located free ends;

a shaft mounted transversally between said free ends of said legs of said L-shaped brackets of said support means housing;

said means connecting respective one ends of said rod means to said support member connecting said one ends of said rod means to said shaft and this connecting means, said shaft and said free ends of said legs being cooperatively constructed and arranged to permit pivotal movement of said rod means angularly of the longitudinal axis of said shaft between a less recumbent position wherein the lower carrying web is oriented relative to the upper carrying web for carrying a sitting person and a more recumbent position wherein the lower carrying web is oriented relative to the upper carrying web for lifting a lying person.

7. The apparatus of claim 6, further including:

a third rod means having a respective one end thereof mounted on said shaft between said legs of said brackets and extending generally medially of said apparatus for pivotal movement angularly of said longitudinal axis of said shaft with the first-described two rod means;

an engagement means adjustably fixed on said third rod means, this engagement means being constructed and arranged to support the lower carrying web between the person's lower thighs.

8. The apparatus of claim 6, wherein:

each said axis about which a respective arm pivots is located in a vertical plane, and also is obliquely oriented, top forwards, so that the substantially complete loop containing both said arms and said upper carrying web, formed when said apparatus is carrying a person suspended in a sitting condition, is oriented at about 30° to the horizontal; and said legs are disposed in an imaginary plane which is adjacent to, below and substantially parallel to an imaginary plane in which said arms are disposed.

9. The apparatus of claim 8, wherein:

said rod means are rotatably mounted on said shaft and said legs and said rod means include cooperating stop shoulder means for limiting pivotal movement of said rod means to define said less recumbent position thereof.

10. The apparatus of claim 9, wherein:

said rod means are rotatably mounted on said shaft by respective holders each of which includes a pivot joint for permitting angular movement of said rod means toward one another; and said apparatus further including spring means for tending to maintain said rod means laterally separated from one another.

11. The apparatus of claim 6, wherein:

said respective engagement means provided on said rod means distally of said one ends of said rod means are longitudinally adjustably received thereon; and said apparatus further includes adjustable means for fixing the last-mentioned engagement means to the respective rod means, so that the distance between said upper carrying web and said lower carrying web may be effectively adjusted.

12. The apparatus of claim 3, wherein:

said pivot means for pivotally connecting the arms to the support member housing includes each arm having an axle which is pivotally mounted to said support member housing, these two axles being located laterally adjacent one another; and a respective pinion gear being fixed on each such axle, these two pinion gears being disposed in meshing relation with one another, so that as one arm is pivoted in one angular sense by a particular amount, the other arm is pivoted in the opposite angular sense by a respective angular amount.

13. The apparatus of claim 1, further including:

block means removably effectively interposed between said arms for substantially limiting pivotal movement of the arms towards one another for maintaining said arms in a substantially spread-apart condition.

* * * * *